United States Patent [19]

Taha

[11] Patent Number: 4,725,455

[45] Date of Patent: Feb. 16, 1988

[54] PROCESS FOR MANUFACTURING PARTICULATE BUILT NONIONIC SYNTHETIC ORGANIC DETERGENT COMPOSITION COMPRISING POLYACETAL CARBOXYLATE AND POLYPHOSPHATE BUILDERS

[75] Inventor: Riad A. Taha, Spotswood, N.J.

[73] Assignee: Colgate-Palmolive Company, New York, N.Y.

[21] Appl. No.: 616,460

[22] Filed: Jun. 1, 1984

[51] Int. Cl.[4] ..... B05D 7/00; C11D 17/00

[52] U.S. Cl. ..... 427/221; 427/220; 252/91; 252/174.14; 252/174.21; 252/174.24; 252/174.25; 252/174; 252/135; 252/140

[58] Field of Search ..... 252/89, 95, 99, 98, 252/187 C, 174.24, 91, 174, 174.13, 174.14, 174.21, 174.25; 427/220, 221

[56] References Cited

U.S. PATENT DOCUMENTS

| | | | |
|---|---|---|---|
| 4,144,225 | 3/1979 | Crutchfield et al. | 528/231 |
| 4,146,495 | 3/1979 | Crutchfield et al. | 252/174.21 |
| 4,284,524 | 8/1981 | Gilbert | 252/99 |
| 4,315,092 | 2/1982 | Crutchfield et al. | 528/230 |
| 4,344,871 | 8/1982 | Allaway et al. | 252/531 |

FOREIGN PATENT DOCUMENTS 0021491 1/1981 European Pat. Off. .

*Primary Examiner*—Paul Lieberman
*Assistant Examiner*—John F. McNally
*Attorney, Agent, or Firm*—H. S. Sylvester; M. M. Grill; N. Blumenkopf

[57] ABSTRACT

A particulate built nonionic synthetic organic detergent composition includes a detersive proportion of a nonionic synthetic organic detergent and a building proportion, in combination, of a polyacetal carboxylate builder for the nonionic detergent and a polyphosphate builder for such nonionic detergent. Such compositions are readily made by adding polyacetal carboxylate builder to the formula of a control detergent composition, with corresponding diminutions of other component(s), and have detersive powers superior to such control despite the decrease in detergent and other builders. Preferably, certain nonionic detergents, polyacetal carboxylate builders and polyphosphate, in certain proportions, are employed for better detergency and physical characteristics, e.g., flowability.

Process for manufacturing the described detergent compositions are disclosed, in which processes spray dried builder base beads, containing polyphosphate builder salt, have nonionic detergent and polyacetal carboxylate builder mixed with or applied to them. Also described are pumpable and sprayable compositions of polyacetal carboxylate builder in normally solid, liquid nonionic detergent at elevated temperature, which compositions are suitable for applying the nonionic detergent and polyacetal carboxylate builder to spray dried polyphosphate base beads, preferably as a spray onto moving surfaces of such beads.

9 Claims, No Drawings

PROCESS FOR MANUFACTURING PARTICULATE BUILT NONIONIC SYNTHETIC ORGANIC DETERGENT COMPOSITION COMPRISING POLYACETAL CARBOXYLATE AND POLYPHOSPHATE BUILDERS.

This invention relates to a particulate built nonionic synthetic organic detergent composition. More particularly, it relates to such a composition containing a building proportion, in combination, of polyacetal carboxylate and polyphosphate builders for the nonionic detergent. The invention also includes processes and compositions useful in manufacturing such products.

Particulate nonionic detergent products are known wherein base beads, comprised mostly of inorganic builder salt(s), e.g., polyphosphates, obtained by spray drying an aqueous crutcher mix or slurry, have normally solid nonionic detergent in liquid state absorbed by them, to produce free flowing particulate compositions. Polyacetal carboxylate builder salts suitable for use as builders with various organic detergents, primarily anionic organic detergents, have been described in the literature and in various U.S. and foreign patents. However, before the present invention, particulate built nonionic synthetic organic detergent compositions containing polyphosphate and polyacetal carboxylate builders in a total building proportion had not been disclosed and the advantages of such compositions and of processes for their manufacture, wherein the polyacetal carboxylate and nonionic detergent were applied to base beads of polyphosphate builder salt, were not known.

Particulate nonionic detergent compositions in which the nonionic detergent is applied in liquid state to porous base beads containing polyphosphate builder salt are described in U.S. Pat. No. 4,269,722, and such compositions have been marketed under the trademark FRESH START®. Polyacetal carboxylates are described in U.S. Pat. Nos. 4,144,226 and 4,315,092. U.S. Pat. Nos. 4,146,495 and 4,219,437 claim detergent compositions containing the polyacetal carboxylate builder (U.S. Pat. No. 4,146,495) and similar compositions containing keto dicarboxylates (U.S. Pat. No. 4,219,437), which can often be employed in replacement of the polyacetal carboxylates. Various other patents on similar builders include U.S. Pat. Nos. 4,141,676; 4,169,934; 4,201,858; 4,204,852; 4,224,420; 4,225,685; 4,226,960; 4,233,422; 4,233,423; 4,302,564; and 4,303,777. Also relevant are European patent application Nos. 0 015 024; 0 021 491; and 0 063 399. Although in some such patents and/or applications there are included broad teachings that polyacetal carboxylates may be included in various types of detergent compositions, and although some such polyacetal carboxylates are described as components of compositions containing nonionic detergents and cationic softening agents, none of the references or combinations thereof describes or suggests such polyacetal carboxylates as components of the nonionic detergents of the present invention and none teaches the obtaining of the described improved detergency of the invented compositions and the free flowing nature of the products made. Also, the manufacturing processes and the detergent composition employed in such processes are not described or fairly suggested in any such reference or in any combination thereof.

In accodance with the present invention a particulate built nonionic synthetic organic detergent composition comprises a detersive proportion of a nonionic synthetic organic detergent, and a building proportion, in combination, of a polyacetal carboxylate buileer for the nonionic detergent and a polyphosphate builder for the nonionic detergent. Preferably, certain nonionic detergents, polyacetal carboxylate builders and polyphosphate builder are utilized in certain proportions and the product obtained is a free flowing particulare built detergent composiiton of improved detergency (or soil removing properties). Also within the invention are processes for making such particulate detergents and detergen compositions useful for converting spray dried base builder beads to finished particluate detergents of this invention by spraying such intermediate detergents onto spray dried base beads of polyphosphate builder salts.

The polyacetal carboxylate may be considered to be that described in U.S. Pat. No. 4,144,226 and may be made by the method mentioned therein. A typical such product will be of the formula

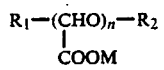

wherein M is selected from the group consisting of alkali metal, ammonium, alkyl groups of 1 to 4 carbon atoms, tetraalkylammonium groups and alkanolamine groups, both of 1 to 4 carbon atoms in the alkyls thereof, n averages at least 4, and $R_1$ and $R_2$ are any chemically stable groups which stabilize the polymer against rapid depolymerization in alkaline solution. Preferably the polyacetal carboxylate will be one wherein M is alkali metal, e.g., sodium, n is from 4 to 200, $R_1$ is

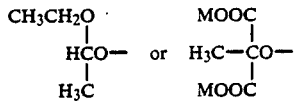

or a mixture thereof, $R_2$ is

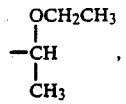

and n preferably averages from 20 to 100, more preferably 30 to 80. The calculated weight average molecular weights of the polymers will normally be within the range of 2,000 to 20,000, preferably 3,500 to 10,000 and more preferably 5,000 to 9,000, e.g., about 8,000.

Although the preferred polyacetal carboxylates have been described above, it is to be understood that they may be wholly or partially replaced by other such polyacetal carboxylates or related organic builder salts described in the previously cited patents on such compounds, processes for the manufacture thereof and compositions in which they are employed. Also, the chain terminating groups described in the various patents, especially U.S. Pat. No. 4,144,226, may be utilized, providing that they have the desired stabilizing properties, which allow the mentioned builders to be depolymerized in acidic media, facilitating biodegradation thereof in waste streams, but maintain their stability in alkaline media, such as washing solutions.

The polyphosphate builder is highly preferably sodium tripolyphosphate but other water soluble alkali metal polyphosphates may also be employed, such as tetrasodium pyrophosphate and corresponding potassium salts. Such may be in anhydrous, hydrated or partially hydrated state and the product will preferably include at least about 10%, more preferably at least 25% of the polyphosphate present in the form of hydrated polyphosphate, preferably pentasodium tripolyphosphate hexahydrate. Instead of the mentioned polyphosphate, other phosphates may also be employed in part, usually up to about 50% of the polyphosphate content of the detergent composition, but it is more preferred to maintain essentially all of the phosphate present as polyphosphate and preferably as pentasodium tripolyphosphate, at least some of which is hydrate, e.g., 50 or 100% thereof.

The third component of the present detergent compositions is a nonionic synthetic organic detergent or a mixture of such detergents. While various suitable nonionic detergents having the desired detersive properties and physical characteristics (normally solid, at room temperature, but liquefiable so as to be capable of being applied to base beads in liquid form) may be employed, at least as a part of such detergent content of the invented compositions, very preferably the nonionic detergent will be a condensation product of ethylene oxide and a higher fatty alcohol. The ethylene oxide content of such detergents will be within the range of 3 to 20 moles, preferably 3 to 12 moles and more preferably 6 to 8 moles, e.g., about 6.5 or 7 moles of ethylene oxide, per mole of fatty alcohol, and the fatty alcohol will usually be of 10 to 18 carbon atoms, preferably averaging 12 to 15 carbon atoms, e.g., about 12 to 13 carbon atoms. Among other nonionic detergents that are also useful are the ethylene oxide condensation products of alkylphenols of 5 to 12 carbon atoms in the alkyl group, such as nonylphenol, in which the ethylene oxide content is from 3 to 30 moles per mole, and condensation products of ethylene oxide and propylene oxide, sold under the trademark Pluronic®.

Although essentially anhydrous products can be manufactured and are useful, usually moisture will be present in the detergent composition, either in free form or as a hydrate, such as a polyphosphate hydrate. The presence of such a hydrate helps to strengthen the detergent composition particles and sometimes facilitates dissolving of such particles in the wash water. For such reasons, and to facilitate manufacturing, moisture is preferably present in the product.

In addition to the mentioned components, other materials, such as a supplementing builder (sodium silicate) and adjuvants may be employed. Also, in some cases condensation products of higher fatty alcohol and ethylene oxide of greater ethylene oxide contents than 20 moles per mole may be employed in substitution for some of the condensation products of lesser ethylene oxide content. Thus, if it is desirable to further improve flowability of a preferred product a harder nonionic component, such as one of 21 to 50 ethylene oxide groups per mole, may be utilized in part, in which case it will desirably be from 1 to 50%, usually more preferably from 5 to 25% of the total nonionic detergent content. Also, sodium silicate, which has a supplementing building action and aids in inhibiting corrosion of aluminum items in wash water containing the detergent composition, will be of $Na_2O:SiO_2$ ratio in the range of about 1:1.6 to 1:3, preferably 1:2 to 1:2.6, e.g., 1:2.35 or 1:2.4.

Among the various adjuvants that may be employed are colorants, such as dyes and pigments, perfumes, enzymes, stabilizers, antioxidants, fluorescent brighteners, buffers, fungicides, germicides, and flow promoting agents. If desired, fillers, such as sodium sulfate and/or sodium chloride, may also be present. Also among the "adjuvants" are included various fillers and impurities in other components of the compositions, such as $Na_2CO_3$ in the polyacetal carboxylate (Builder U).

The proportions of the various components that will result in the desired improved detersive properties (previously mentioned) will normally be from 5 to 35% of nonionic detergent, and from 30 to 95% of a combination of polyacetal carboxylate and sodium tripolyphosphate builders. The ratio of the polyacetal carboxylate to polyphosphate will be in the range of 1:5 to 2:1, preferably 1:5 to 3:2, and more preferably 1:4 to 1:1, e.g., about 1:3. Any balances of such compositions will be filler(s), other builder(s), adjuvant(s) and moisture. Usually the nonionic detergent content will be at least 5% of the product and the polyphosphate builder content will be at least 15% thereof. The nonionic detergent content will preferably be 10 to 30%, more preferably 10 to 20%, e.g., about 16%, the polyacetal carboxylate will preferably be 10 to 40%, more preferably 12 to 30%, e.g., 18% or 23%, and the polyphosphate, e.g., sodium tripolyphosphate, will preferably be from 20 to 75%, more preferably 25 to 55%, e.g., about 43%, of the detergent composition. The moisture content of the product will usually be from 1 to 20%, preferably 3 to 15% and more preferably from 5 to 12%, e.g., about 7%. Such moisture content includes that which is removable from the product in standard oven drying (105° C. for two hours). The sodium silicate content, when sodium silicate is present, will be from 1 to 15%, preferably 2 to 12% and more preferably 5 to 10%, e.g., about 7%. The total percentage of adjuvants may range from 0 to 20% but normally will be at the lower end of such range, 1 to 10%, preferably 2 to 6%, e.g., about 4% or 5%, with individual adjuvant percentages usually being from 0.1 to 5%, preferably 0.2 to 3%. In the foregoing description and elsewhere in the specification the percentages of polyphosphate given are on an "anhydrous" basis, and do not include moisture that is removable by oven drying, as described above. The content of filler(s) may be as high as 40% in some instances but usually, if filler is present, the proportion thereof will be in the range of 5 to 30%.

The particulate detergent product of this invention may be made by the method described in U.S. Pat. No. 4,269,722. That patent and U.S. Pat. No. 4,144,226 are hereby incorporated by reference. Following such method, an aqueous slurry is made which includes the particulate polyphosphate, sodium silicate, usually added as an aqueous solution, water, and any suitable fillers and adjuvants, such as fluorescent brightener and pigment which may be present. Sodium sulfate has been found to adversely affect flowability of the detergent composition, when added to the base beads with nonionic detergent so its presence is sometimes avoided. In some instances the polyacetal carboxylate builder may be added in the crutcher but because it has sometimes been found to be of limited stability when processed at elevated temperature, such builder is often post-added. Generally the crutcher mix is at a solids content in the range of 40 to 70% and is heated to a temperature in the range of 40° to 70° C. Anhydrous or hydrated pentasodium tripolyphosphate or other suitable polyphosphate may be employed. However, a major proportion of the nonionic detergent component will not be present in the crutcher; instead, it will be post added, and preferably the proportion of nonionic detergent in the crutcher will be limited to about 4%, preferably 2% (on a final product basis), so as to avoid loss of such detergent during the spray drying operation. If agitation to produce uniformity of the mix is difficult, because of excessive gelation or thickening of the mix, viscosity control agents, such as citric acid, magnesium sulfate and/or magnesium citrate may be employed. Such thinning agents will be considered to be within the group designated "adjuvants". After thorough mixing in the crutcher, which may take from 10 minutes to an hour, the crutcher slurry is pumped to a conventional spray drying tower, either concurrent or countercurrent, in which it is dried by heated drying air at a temperature in the range of 200° to 500° C., preferably 200° to 350° C. if the mix contains polyacetal carboxylate, to produce globular spray dried particles of sizes in the range of Nos. 8 to 100 sieves, U.S. Sieve Series. All the spray dried particles will pass through the No. 8 sieve and normally no more than 5% thereof will pass through the No. 100 sieve, with less than 3% normally passing a No. 200 sieve.

The porous base beads resulting are introduced into a suitable batch or continuous mixer or blender, such as an inclined rotary drum (batch), in which they are post sprayed at a suitable temperature at which the nonionic detergent is liquid, usually in the range of 45° to 60° C., preferably 45° to 50° C. In one embodiment of the invented process all the nonionic detergent, in liquid state and preferably at elevated temperature in the described preferred range, is sprayed onto the moving surfaces of the mass of base beads by means of an atomizing nozzle of conventional type, and during mixing it penetrates into the interiors of the beads, with some of nonionic detergent being near the surface thereof. Then, without cooling to the solidification point of the detergent, the polyacetal carboxylate builder, in finely divided powdered form, as of particle sizes in the range of 200 to 400 mesh (although coarser particles as large as No. 100, U.S. Sieve Series, may also be used), is dusted onto the moving base beads, which now contain absorbed nonionic detergent. Some of the finely divided polyacetal carboxylate particles are drawn into the interstices and cavities of the beads by the still liquid nonionic detergent and others adhere to such detergent near the surfaces of the beads, and are held to the beads as the detergent is cooled to solidification. In such operation the polyacetal carboxylate which is held to the base beads inhibits the production of tacky product. At the same time, the holding of it to the beads prevents stratification of the product in its end use package during shipment and storage.

Various adjuvants of the types that would normally be post-added, such as enzyme powders and perfumes, may be added with the polyacetal carboxylate powder or before or after the powder addition. Usually, as with the nonionic detergent, it is preferred to spray liquid components onto the surfaces of the intermediate detergent composition particles but in some instances, as is also the case with application of the nonionic detergent in liquid state to the base beads, spraying is unnecessary and dripping of the liquid also serves to distribute it satisfactorily and to promote absorption of it into the porous particles. Powdered materials being added are preferably in finely divided powdered form, as described above for the polycarboxylate builder, but other particle size ranges may also be utilized (as they may be for the builder), although in such cases the results may not be as satisfactory. Also, instead of spraying the liquid material onto spray dried polyphosphate base beads for absorption, in some instances one may apply the liquid to granular (not spray dried) polyphosphate particles, but such is not usually as satisfactory because such particles do not normally have the absorbing capacity of spray dried base beads.

Instead of having post-applied powdered polyacetal carboxylate particles adhered to liquid detergent that has been applied to base beads, in another and preferred process of this invention the builder is applied to the base beads as a dispersion of the polyacetal carboxylate in the normally solid nonionic detergent at elevated temperature and in liquid state. In such application, some of the polyacetal carboxylate builder may be dissolved in the liquid nonionic detergent but normally more of it is dispersed therein, preferably in finely divided particles, such as those smaller than 200 mesh, and preferably larger than 400 mesh. In such applications the base beads may be heated initially to a temperature like that of the liquid state detergent being applied but it has been found that although theoretically such an operation would be thought to promote greater absorption of the detergent and polyacetal carboxylate builder, in practice it is sufficient for the base beads to be at room temperature, at which satisfactory absorption and quick cooling of the product result. The dispersion of polyacetal carboxylate builder particles in liquid state nonionic detergent is preferably sprayed onto a moving bed of base beads but sometimes spraying is unnecessary, and mere dripping of the liquid medium onto the base beads is satisfactory, and in some instances it is enough merely to admix the base beads and the dispersion together without any concern for the mode of application of the liquid dispersion to the base beads being required.

The temperature of the dispersion of polyacetal carboxylate particles in a nonionic detergent may be such as has been found to be suitable for use in the application process described. Normally such temperature will be in the range of 45° to 95° C. but preferably, so as better to maintain stability of the polyacetal carboxylate and to promote quicker cooling after application thereof to the base particles, the temperature of application will be in the range of 45° to 60° C., most preferably about 45° to 50° or 55° C. However, this depends on the solidification point of the nonionic detergent, which will be the same as or lower than the lowest temperature of such a range. Of course, with higher melting nonionic detergents the lower limit of the range will be adjusted accordingly, usually being at least 2° and preferably at least 5° or 10° higher than the solidification point. The polyacetal carboxylate will preferably be of particle sizes, substantially all (usually more than 90%, preferably more than 95% and more preferably more than 98%) of which are no larger than that which will pass through a No. 200 sieve, U.S. Sieve Series (or a 200 mesh sieve). However, larger sized particles may be employed but generally are not larger than 100 or 160 mesh. Preferably the particles will be in the 200 to 400 mesh range, e.g., 200 to 325 mesh, to promote penetrations into interstices of the base beads and to promote better holdings to the surfaces thereof.

In the dispersions mentioned, in which some of the polyacetal carboxylate may be in solution, the proportion of polyacetal carboxylate to nonionic detergent will normally be in the range of 1:20 to 3:2, preferably 1:10 to 1:1 and more preferably 1:2 to 1:1. However, such proportions may be adjusted, depending on the formula proportions of the polyacetal carboxylate and nonionic detergent desired to be in the end product. Still, normally no more than three parts of polyacetal carboxylate will be present with two parts of nonionic detergent, and preferably such upper limit will be 1:1. If more polyacetal carboxylate is wanted in the product formula it may be post-applied, as previously described, after absorption of some of the polyacetal carboxylate and the liquid state nonionic detergent. While other materials, including particulate materials, such as enzymes, may be postadded, sometimes they may also be dissolved and/or dispersed in the nonionic detergent, with the polyacetal carboxylate and may be applied to the base beads together with such builder and detergent.

In some cases, some (sometimes all) of the polyacetal carboxylate may be spray dried with the polyphosphate builder(s) but in such instances the employment of mild conditions will be desired, with special care being taken not to allow buildup of product on the spray tower interior walls, where the polyacetal carboxylate could be decomposed. So long as the spray tower conditions are such that the bead temperatures do not rise to a destabilizing temperature for the polyacetal carboxylate employed, spray drying is feasible but because this cannot always be assured in commercial spray drying processes, as a practical matter it is often preferable to post-apply the polyacetal carboxylate.

The product of the formulations given, produced by any of the methods described, is satisfactorily free flowing, non-tacky and non-caking despite its contents of nonionic detergent and polyacetal carboxylate. The particles thereof are regular in shape, approximating the spherical, and the product is of desired bulk density (higher than the bulk density of usual spray dried products, which tends to be in the range of 0.25 to 0.4 g./ml.), normally being in the range of about 0.5 to 0.8 g./ml.,such as 0.6 to 0.7 g./ml. Thus, smaller packages may be employed, creating more available supermarket shelf space and facilitating home laundry storage. The detergent composition made is an excellent detergent, with improved cleaning power against a variety of soils. Its detergency is greater than that of a control detergent without the polyacetal carboxylate. Surprisingly, the detergency of the present compositions is better than that of a control, despite the fact that the proportion of nonionic detergent in the control is higher. It should be pointed out that the total content of builder is greater in the "experimental" product, but then too, the contents of polyphosphate builder and silicate are lower.

The following examples illustrate but do not limit the invention. Unless otherwise indicated all temperatures are in °C. and all parts are by weight in the examples, elsewhere in the specification, and in the claims.

EXAMPLE 1

| Component | Parts |
|---|---|
| Sodium tripolyphosphate (anhydrous basis)[1] | 43.4 |
| Higher fatty alcohol polyethoxylate nonionic detergent[2] | 15.9 |
| Sodium polyacetal carboxylate [Builder U][3] | 23.1 |

-continued

| Component | Parts |
|---|---|
| Sodium silicate ($Na_2O:SiO_2$ = 1:2.4) | 7.3 |
| Moisture | 7.3 |
| Enzyme powder (proteolytic enzyme, 200 mesh) | 1.52 |
| Fluorescent brightener (Tinopal 5BM Conc.) | 1.13 |
| Blue dye | 0.16 |
| Perfume | 0.19 |
| | 100.0 |

[1]Pentasodium tripolyphosphate powder, humidified.
[2]Condensation product of 6.5 moles of ethylene oxide and one mole of higher fatty alcohol of 12-13 carbon atoms, sold as Neodol 23-6.5 by Shell Chemical Company
[3]Supplied by Monsanto Company (as Builder U), having a calculated weight average molecular weight of about 8,000, and of about 80% active polymer content.

The particulate determgent composition of the above formula is made by spray drying some of the formula, including the sodium tripolyphosphate, to produce base beads, and then post-blending with such base beads other component of the formula, including the nonionic determgent, polyacetal carboxylate, enzyme and perfume. The crutcher mix or slurry is made by sequentially adding to a detergent crutcher 47.8 parts of water (preferably deionized water but city water of up to 150 p.p.m. $CaCO_3$ equivalent may be employed), 37.8 parts of pentasodium tripolyphosphate—Hum., 13.3 parts of a 47.5% aqueous solution of sodium silicate of $Na_2O$:-$SiO_2$ ratio of about 1:2.4, 0.98 part of fluorescent brightener (Tinopal 5BM Conc.) and 0.06 part of blue dye, and mixing at a temperature of about 45° C. during such additions and for about 20 minutes thereafter, after which the crutcher slurry, of a solids content of about 45%, is dropped to a high pressure pump which pumps it through atomizing nozzles at the top of a countercurrent spray drying tower, in which heated drying air at a temperature of about 325° C. dries it to essentially globular porous particles of sizes in the Nos. 10 to 100 sieves (U.S. Sieve Series) range, and of a moisture content of about 12.7%. In some instances a minor proportion of recycled base beads (or final product) may be included in the crutcher mix for reworking, with appropriate modifications of the formula to allow for such.

The base beads resulting, usually at about room temperature but in some cases still at a temperature between the tower bottom air temperature and room temperature, nearer to room temperature (sometimes 5° to 30° C. above it), are charged to a blending apparatus, in this case an inclined rotary drum, in which there are successively added to 77.05 parts of the base beads, 20.72 parts of the ethoxylated alcohol nonionic detergent, 30 parts of Builder U, 1.98 parts of enzyme and 0.25 part of perfume. The ethoxylated alcohol is sprayed onto the moving bed of base beads at an elevated temperature, 50° C., at which it is in liquid state. The Builder U and proteolytic enzyme (mixtures of amylolytic and proteolytic enzymes, e.g., 1:1 mixtures, may also be used) are "dusted" onto the moving bed of base beads after absorption thereby of the nonionic detergent (which usually occurs within about 2 to 10 minutes), after which the perfume is sprayed onto such moving intermediate product. The particulate detergent composition resulting has a $P_2O_5$ content of 24.8%, is of particle sizes in the range of Nos. 10 to 100 sieves, U.S. Sieve Series, and is of a bulk density of 0.67 g./ml. At room temperature it is free flowing, non-tacky and non-caking. After cooling and screening, if that is desired, to obtain all or substantially all of the particles in the desired Nos. 10 to 100 sieve range, the product is packed, cased, warehoused and shipped. It is found to be of uniform composition throughout the package and the contents of various packages are also uniform. It is also non-settling during shipping and storage.

A comparative product is made in the same manner as previously described except for the omission of the sodium polyacetal carboxylate (Builder U) from it. Thus, instead of 100.0 parts of product, 76.9 parts are made, and the proportions of the various components in the product are 30% greater than those given in the above formula. When the "experimental" product is tested against the "control" for detergency, in a standard soil removal test which utilizes different soils deposited on a variety of substrate fabrics, the invented product is found to be significantly better in soil removal activity (or detergency) than the control.

In the detergency tests employed an automatic washing machine containing 67 liters of water at 49° C. has charged to it four pounds of clean clothes and three swatches each of five different test fabrics. The first and second such test fabrics are obtained from Test Fabric Company. The first has a soil of graphite, mineral oil and thickener on nylon and the second has a soil of sebum, particulate material and kaolin on cotton. The third test fabric is cotton soiled with New Jersey clay and the fourth fabric is a cotton-dacron blend soiled with such clay. The fifth test fabric, identified as EMPA 101, is of cotton and it is soiled with a mixture of sebum soil, carbon black and olive oil.

After washing of sets of the test fabric swatches, one set being washed in an automatic washing machine,to the wash water of which the invented composition has been charged, with the concentration thereof in the wash water being 0.07%, the wash water being of a hardness of about 150 p.p.m., calcium carbonate equivalent (Ca:Mg ratio of 3:2), and with the time for the washing portion of the cycle being about 10 minutes, and the other set, to the wash water for which the control composition has been charged, being washed subsequently in the same machine, and after dryings, reflectances of the swatches are measured and the averages for each soiled test fabric are taken. Utilizing different factors that have been found by experience to be representative of human evaluations of the importance of a detergent's cleaning powers against the various soils, the final soil removal indices are obtained for the experimental and control detergent compositions. The soil removal index for the invented product is 25.3 points higher than that for the control, indicating a very substantial improvement in detergency for the invented composition.

When, in the formulation of the invented product other nonionic detergents are employed, such as Neodol® 25-7, Alfonic® 1618-65, or a suitable ethylene oxide-propylene oxide condensation product such as those marketed under the trademark Pluronic®, similar improved detergency results, compared to a control from which the polyacetal carboxylate has been omitted. Also, when part of the pentasodium tripolyphosphate is replaced by tetrasodium pyrophosphate, e.g., up to 50%, comparable results are obtained. This is also the situation when the silicate employed is of $Na_2O$:-$SiO_2$ ratio of about 1:2. Changes in the adjuvants utilized, such as omission of the enzyme or replacement of it with amylolytic enzyme, or addition of relatively small proportions of filler, such as NaCl and $Na_2SO_4$, or the presence of other builders, such as zeolites, will result in the invented products also showing the described type of improvement over the control. This is also true when different polyacetal carboxylates, such as those of potassium, ammonium, lower alkyl and alkanolamine are present, of 1 to 4 carbon atoms in the alkyls thereof, when the end terminating groups employed are others than the present ones, given in the preceding formula, such others being those described in U.S. Pat. No. 4,144,226, and when the calculated weight average molecular weights of the polyacetal carboxylate are 5,000 or other weights within the described preferred range of 3,500 to 10,000. Of course, when the less desirable components are employed the difference in detergency may not be as great.

Similarly, comparable results are obtained when the manufacturing of the product is effected in other ways, under different conditions, as previously described, and utilizing components in different proportions, also as previously described. For example, when the composition of the formula is varied by changing the proportions of components ±10, ±20 and ±30%, while maintaining them within the ranges given, similar results are obtained.

EXAMPLE 2

Ten parts of Neodol 25-7 (a condensation product of 7 moles of ethylene oxide and one mole of higher fatty alcohol of 12 to 15 carbon atoms, on the average), and ten parts of Builder U, of calculated weight average molecular weight of about 8,000, are converted to a liquid state dispersion-solution by heating to about 92° C. The builder powder, of particle sizes in the range of 325 to 400 mesh, does not dissolve in the hot nonionic detergent but disperses well therein. The dispersion thus made is applied as a spray at an elevated temperature within the range of 45° to 92° C., preferably 50° to 60° C., to 50 parts of base beads (in a moving bed) comprising 74% of sodium tripolyphosphate, 12% of sodium silicate ($Na_2O$:$SiO_2$=1:2.4), 1.7% of fluorescent brightener, 0.1 percent dye and about 10% of moisture. The product resulting is free flowing, non-caking and non-tacky, and is of excellent appearance. When tested against a control, from which the Builder U has been omitted, it is found to be of significantly better detergency.

Similar results are obtainable when other polyphosphates, nonionic detergents and polyacetal carboxylates are employed, and in different proportions, within the descriptions previously given.

To improve flowability, non-tackiness and non-caking properties further, if desired, there may be dusted onto the beads, after absorption of the nonionic detergent and Builder U, about 5 parts of finely divided Zeolite 4A or other suitable zeolite, or the zeolite, of particle sizes like those of the builder, may also be dispersed in the nonionic detergent and applied to the base beads with the nonionic and builder. If zeolite is employed (and it may be spray dried with the polyphosphate too) it will preferably be a Zeolite A (4A is most preferred) of particle size of 200 to 400 mesh, preferably 325 to 400 mesh (if dispersed in nonionic or post-applied) and the proportion thereof will be from 5 to 40%, preferably 10 to 20%, and the zeolite:nonionic ratio will be from 1:20 to 1:1. The ratio of the sum of zeolite and polyacetal carboxylate to nonionic detergent in such dispersion will preferably be in the range of 1:10 to 1.2:1.

When insufficient polyacetal carboxylate is applied from the nonionic detergent dispersion onto the base beads, the desired additional proportion is post-added, with or without post-added zeolite.

The procedure of Example 2 is repeated but the composition is made by applying the Neodol 25-7, in liquid state, at a temperature of 50° C., to the moving base beads by spraying it thereon, after which a finely divided Builder U powder (200 to 400 mesh) is admixed with the intermediate product. The powder adheres to the surface of the nonionic detergent and the product resulting is free flowing, non-tacky, non-caking and non-settling on storage. Its detergency is essentially the same (superior), compared to a control, as that of the same composition of Example 2.

Variations in the formula of Examples 2 and 3 may be made, as by utilizing different nonionic detergents, such as those which have been described previously, and polyacetal carboxylates of other types, previously mentioned. Variations also can be made in the base bead formulations, as have been described earlier. In all such instances, the product resulting will be satisfactory and will be of improved detergency, compared to a control from which the polyacetal carboxylate component has been omitted. In some instances, as when the proportion of Builder U and/or nonionic detergent employed is sufficiently high so that flowability could desirably be improved, flow improving agents (zeolite builders can perform such function) may be incorporated in the final product, preferably by mixing them with the Builder U and applying the mixture thereof to the base beads, already containing deposited nonionic detergent in liquid state and at elevated temperature, or by applying the flow-improving agent after absorption by the base beads of the nonionic detergent-polyacetal carboxylate dispersion.

The mixing procedures and apparatuses may be changed too. For example, instead of mixing for twenty minutes in a batch process employing an inclined drum, mixing time may be changed to from 5 to 40 minutes, and other apparatuses may be used, such as V-blenders, fluid beds, Schugi mixers and Day mixers. The results from such changes will still be acceptable product of the desired characteristics and washing properties, with a desired bulk density being in the range of 0.6 to 0.8 g./ml., as in these working examples.

The invention has been described with respect to various illustrations and working embodiments thereof but it is to be understood that it is not limited to these because one of skill in the art, with the present specification before him or her, will be able to utilize substitutes and equivalents without departing from the invention.

What is claimed is:

1. A process for manufacturing a particulate built nonionic synthetic organic laundry detergent composition, which composition comprises a detersive proportion, 10 to 30%, by weight, of a nonionic detergent which is a condensation product of 3 to 20 moles of ethylene oxide and a mole of fatty alcohol of 10 to 18 carbon atoms per mole, and a building proportion of a combination of polyacetal carboxylate builder of calculated weight average molecular weight in the range of 5,000 to 9,000, and sodium tripolyphosphate builder, with the proportion of polyacetal carboxylate being 10 to 40%, by weight, and the proportion of sodium tripolyphosphate being 20 to 75%, by weight, and with the ratio of polyacetal carboxylate to sodium tripolyphosphate being within the range of 1:5 to 2:1, weight, and with the balance of the composition, if any, being selected from the group consisting of fillers, other builders, adjuvants and moisture, and mixtures thereof, which process comprises the steps of spray drying an aqueous crutcher mix of the polyphosphate builder salt, mixing the resulting spray dried beads with the nonionic detergent in liquid form at elevated temperature, whereby the detergent is absorbed into the beads, and mixing such beads, containing the nonionic detergent, with the polyacetal carboxylate builder, whereby said builder is held to such beads and a free flowing particulate detergent composition results.

2. A process according to claim 1 which comprises the step of applying 5–40% by weight finely divided zeolite to the product of claim 1 to cover the carboxylate builder and the nonionic detergent, so as to improve the free flowing characteristics of the product.

3. A process according to claim 1 wherein the aqueous crutcher mix is of a solids content in the range of 40 to 70%, by weight, is at a temperature in the range of 40° to 70° C., and is mixed for a period of ten minutes to an hour, the spray drying of the crutcher mix is in drying air which is at a temperature of 200° to 500° C., the spray dried beads resulting are of sizes in the range of Nos. 8 to 100 sieves, U.S. Sieve Series, and are porous, mixing is effected in an inclined rotary drum mixer in which the porous spray dried beads are post sprayed with liquid state nonionic detergent at a temperature in the range of 45° to 60° C., and the polyacetal carboxylate builder is of particle sizes in the range of 200 to 400 mesh, U.S. Sieve Series, and is dusted onto the moving base beads containing liquid state nonionic detergent so as to be adhered thereto.

4. A process according to claim 3 wherein finely divided zeolite powder, of particle sizes within the range of 200 to 400 mesh, U.S. Sieve Series, is dusted onto the beads made by such claimed process to cover the polyacetal carboxylate builder and the nonionic detergent, so as to improve the free flowing characteristics of the product and impart its building effect.

5. A process for manufacturing a particulate built nonionic synthetic organic laundry detergent composition, which composition comprises a detersive proportion, 10 to 30%, by weight, of a nonionic detergent which is a condensation product of 3 to 20 moles of ethylene oxide and a mole of fatty alcohol of 10 to 18 carbon atoms per mole, and a building proportion of a combination of polyacetal carboxylate builder of calculated weight average molecular weight in the range of 5,000 to 9,000, and sodium tripolyphosphate builder, with the proportion of polyacetal carboxylate being 10 to 40%, by weight, and the proportion of sodium tripolyphosphate being 20 to 75%, by weight, and with the ratio of polyacetal carboxylate to sodium tripolyphosphate being within the range of 1:5 to 2:1, by weight, and with the balance of the composition, if any, being selected from the group consisting of fillers, other builders, adjuvants and moisture, and mixtures thereof, which process comprises the steps of dissolving and/or dispersing the polyacetal carboxylate builder in the nonionic detergent in liquid form at elevated temperature, spray drying an aqueous crutcher mix of the polyphosphate builder salt, and applying to the resulting spray dried beads the polyacetal carboxylate builder-nonionic detergent solution or dispersion, with mixing, whereby such solution or dispersion is sorbed by the polyphosphate beads, producing a freeflowing particulate detergent composition.

6. A process according to claim 5 which comprises the step of applying 5–40%, by weight, finely divided zeolite to the product of claim 5, to cover the carboxylate builder and the nonionic detergent, so as to improve the free flowing characteristics of the product.

7. A process according to claim 5 which comprises the steps of dispersing finely divided zeolite particles in the nonionic detergent with the polyacetal carboxylate builder and applying such dispersion to the spray dried beads.

8. A process according to claim 5 wherein the polyacetal carboxylate builder is in particulate form of sizes within the range of 200 to 400 mesh, U.S. Sieve Series, is dissolved and/or dispersed in the liquid state nonionic detergent, which is at a temperature in the range of 45° to 60° C., at which temperature the nonionic detergent is in liquid state, the aqueous crutcher mix comprises 40 to 70%, by weight, of solids and is at a temperature in the range of 40° to 70° C., the spray drying of the aqueous crutcher mix is into drying air which is at a temperature in the range of 200° to 500° C., the spray dried beads resulting are of particle sizes in the range of Nos. 8 to 100 sieves, U.S. Sieve Series, and the polyacetal carboxylated solution/dispersion in nonionic detergent, in which the proportion of polyacetal carboxylate to nonionic detergent is in the range of 1:10 to 1:1, by weight, is sprayed onto moving spray dried beads of sodium tripolyphosphate to produce free flowing, non-tacky and non-caking detergent composition particles which are of regular, approximately spherical shape, and of a bulk density in the range of 0.5 to 0.8 g./ml.

9. A process according to claim 8 wherein finely divided zeolite, of particle sizes within the range of 200 to 400 mesh, U.S. Sieve Series, is applied with the polyacetal carboxylate in the nonionic detergent to the spray dried sodium tripolyphosphate beads, with the proportions of zeolite:nonionic detergent and zeolite+polyacetal carboxylate): nonionic detergent in the liquid solution/dispersion being in the ranges of 1:20 to 1:1, and 1:10 to 1:2.1, respectively.

* * * * *